US007861873B1

(12) United States Patent
Bragg et al.

(10) Patent No.: US 7,861,873 B1
(45) Date of Patent: Jan. 4, 2011

(54) FLIP-TOP DISPENSING SYSTEM WITH A CHILD RESISTANT LATCH MECHANISM

(75) Inventors: Jason Bragg, Owensboro, KY (US); Mark K. Branson, Newburgh, IN (US); Clifton C. Willis, Evansville, IN (US)

(73) Assignee: Rexam Closures and Containers Inc., Evansville, IN (US)

( * ) Notice: Subject to any disclaimer, the term of this patent is extended or adjusted under 35 U.S.C. 154(b) by 754 days.

(21) Appl. No.: 11/754,471

(22) Filed: May 29, 2007

(51) Int. Cl.
*B65D 43/16* (2006.01)
*B65D 51/04* (2006.01)
*B65D 45/16* (2006.01)

(52) U.S. Cl. ..... 215/237; 220/254.5; 220/326

(58) Field of Classification Search ..... 215/243, 215/216, 215, 201, 44, 43, 305, 295, 200; 220/836, 827, 810, FOR. 203, FOR. 195, 220/FOR. 192, 200, 254.9, 830, 833, 264, 220/263, 262, 260, 281; 222/561, 559, 544
See application file for complete search history.

(56) References Cited

U.S. PATENT DOCUMENTS

| | | | | |
|---|---|---|---|---|
| 292,660 | A | 1/1884 | Lang et al. | |
| 3,209,963 | A * | 10/1965 | Krieps et al. | 222/543 |
| 3,307,752 | A | 3/1967 | Anderson | |
| 3,419,198 | A | 12/1968 | Petterson | |
| 3,623,622 | A | 11/1971 | Sullivan | |
| 3,655,102 | A * | 4/1972 | Moran | 222/484 |
| 3,758,000 | A | 9/1973 | Mack | |
| 3,826,394 | A | 7/1974 | Stull | |
| 3,828,981 | A | 8/1974 | Linkletter | |
| 3,845,872 | A | 11/1974 | Towns et al. | |
| 3,869,057 | A | 3/1975 | Miller | |
| 3,873,006 | A | 3/1975 | Fields | |
| 3,927,805 | A | 12/1975 | Stull | |
| 4,047,495 | A | 9/1977 | O'Brien | |
| 4,065,037 | A | 12/1977 | Haller | |
| RE29,793 | E | 10/1978 | Pehr | |
| 4,124,151 | A | 11/1978 | Hazard | |
| 4,170,315 | A | 10/1979 | Dubach et al. | |
| 4,209,100 | A | 6/1980 | Uhlig | |
| 4,220,248 | A * | 9/1980 | Wilson et al. | 215/235 |
| 4,220,262 | A | 9/1980 | Uhlig | |
| 4,236,653 | A | 12/1980 | Gach | |
| 4,244,495 | A | 1/1981 | Lorscheid | |
| 4,257,537 | A | 3/1981 | Uhlig | |
| 4,298,146 | A | 11/1981 | Montgomery | |

(Continued)

FOREIGN PATENT DOCUMENTS

| | | | |
|---|---|---|---|
| CH | 663396 | A5 | 12/1987 |

*Primary Examiner*—Anthony Stashick
*Assistant Examiner*—Robert J Hicks
(74) *Attorney, Agent, or Firm*—Chad D. Bruggeman; John F. Salazar; Middleton Reutlinger

(57) ABSTRACT

A child resistant dispensing system having a flip-top closure. The flip-top closure has a push button positioned in the skirt of the flip-top lid wherein an opposed squeeze disengages the child resistant latch mechanism. The child resistant latch mechanism includes a latch projecting from the flip-top lid and engaging a projection of the closure body. A latch guide assists in positioning the latch during engagement with the projection of the closure body. The push button may be positioned substantially flush with the outside surface of the flip-top lid and closure body.

28 Claims, 11 Drawing Sheets

U.S. PATENT DOCUMENTS 4,310,105 A 1/1982 Gach
4,314,656 A 2/1982 Kessler
4,334,639 A 6/1982 Gach
4,429,800 A 2/1984 Greenspan
4,444,326 A 4/1984 Musel
4,513,888 A 4/1985 Curry
4,635,823 A * 1/1987 Stull ..... 222/108
4,666,068 A * 5/1987 Bush ..... 222/546
4,718,567 A 1/1988 La Vange
4,723,669 A 2/1988 Barriac
4,749,103 A 6/1988 Barriac
4,756,451 A 7/1988 Wilson
4,759,455 A 7/1988 Wilson
4,776,475 A 10/1988 La Vange
4,787,525 A 11/1988 Joyce
4,790,442 A 12/1988 Gach
4,852,770 A 8/1989 Sledge
4,948,002 A 8/1990 Thornock
4,979,648 A 12/1990 Montgomery
5,031,784 A 7/1991 Wright
5,046,629 A 9/1991 Weile
5,088,628 A 2/1992 Knickerbocker
5,104,008 A 4/1992 Crisci
5,141,138 A 8/1992 Odet et al.
5,147,060 A 9/1992 Lima
5,161,706 A 11/1992 Weinstein
5,180,072 A 1/1993 Oehlert
5,203,468 A * 4/1993 Hsu ..... 220/254.3
5,213,223 A 5/1993 Minnette
5,230,433 A 7/1993 Hamilton
5,282,541 A * 2/1994 Chen ..... 215/229
5,328,058 A 7/1994 Leoncavallo
5,348,201 A 9/1994 Koo
5,356,017 A 10/1994 Rohr
5,386,918 A * 2/1995 Neveras et al. ..... 215/235
5,429,255 A 7/1995 Glynn
5,465,876 A 11/1995 Crisci
5,509,550 A 4/1996 DeJonge
5,540,343 A 7/1996 Schumacher
5,558,239 A 9/1996 Dubach
5,577,624 A 11/1996 Berta
5,577,625 A * 11/1996 Baird et al. ..... 215/235
5,577,779 A 11/1996 Dangel
5,579,957 A 12/1996 Gentile et al.
5,622,284 A 4/1997 Sawicki
5,671,853 A 9/1997 Herr
5,735,417 A 4/1998 Darr
5,749,496 A 5/1998 DeJonge, Sr. et al.
5,779,072 A 7/1998 Krebs
5,816,422 A 10/1998 Roig
5,819,967 A 10/1998 Lo
5,850,951 A 12/1998 Hayes
5,850,953 A 12/1998 Dallas, Jr.
5,865,330 A 2/1999 Buono
5,899,348 A 5/1999 Konefal
5,908,125 A 6/1999 Opresco
5,927,526 A 7/1999 Herr
5,927,556 A 7/1999 Mooney et al.
5,967,384 A * 10/1999 Mengeu et al. ..... 222/517
5,979,681 A 11/1999 Varlet et al.
5,988,412 A 11/1999 Minnette et al.
5,992,668 A * 11/1999 Elliott ..... 220/278
5,996,859 A 12/1999 Beck
6,039,196 A 3/2000 Ekkert et al.
6,053,343 A 4/2000 Krueger
6,076,689 A 6/2000 Vassallo
6,082,565 A 7/2000 Harrold
6,095,353 A 8/2000 Gargiulo
6,095,354 A 8/2000 Herr et al.
6,112,921 A 9/2000 Robinson
6,116,477 A * 9/2000 Kreiseder et al. ..... 222/556
6,152,320 A 11/2000 Hierzer et al.
6,176,381 B1 1/2001 Mader
6,202,876 B1 3/2001 DeJonge
6,206,221 B1 3/2001 Bando
6,216,905 B1 4/2001 Mogard et al.
6,234,334 B1 5/2001 Suarez
6,253,938 B1 7/2001 Zaksenberg et al.
6,257,431 B1 7/2001 Baudin
6,283,333 B1 9/2001 Knickerbocker et al.
6,299,005 B1 10/2001 Higgins
6,302,301 B1 10/2001 Vette
6,305,563 B1 10/2001 Elliott
6,311,878 B1 11/2001 Kimble
6,325,252 B1 12/2001 Brozell
6,382,476 B1 * 5/2002 Randall et al. ..... 222/545
6,550,626 B1 * 4/2003 Randall ..... 215/253
6,866,164 B2 3/2005 Branson et al.
6,923,341 B2 8/2005 Smith
7,404,495 B2 7/2008 Keung
2003/0057237 A1 * 3/2003 Stull et al. ..... 222/490
2003/0201283 A1 * 10/2003 Branson et al. ..... 222/153.14
2004/0069806 A1 * 4/2004 Benoit-Gonin et al. . 222/153.06
2005/0023285 A1 * 2/2005 Keung ..... 220/835
2005/0205607 A1 * 9/2005 Hierzer et al. ..... 222/153.1
2006/0000833 A1 1/2006 Boots et al.
2006/0006203 A1 * 1/2006 Stull et al. ..... 222/494
2006/0157516 A1 * 7/2006 Barber ..... 222/420
2006/0186077 A1 8/2006 Robinson
2006/0186079 A1 * 8/2006 Ziegenhorn ..... 215/237
2007/0095864 A1 5/2007 Vangeel et al.
2007/0114201 A1 5/2007 Keung
2007/0125741 A1 6/2007 Keung
2008/0169261 A1 7/2008 Druitt et al.
2009/0127156 A1 5/2009 Tung

* cited by examiner

FLIP-TOP DISPENSING SYSTEM WITH A CHILD RESISTANT LATCH MECHANISM

TECHNICAL FIELD

The present invention relates to a flip-top dispensing system in particularly to a flip-top dispensing system with a child resistant latch mechanism.

DETAILED DESCRIPTION

Figure 1:
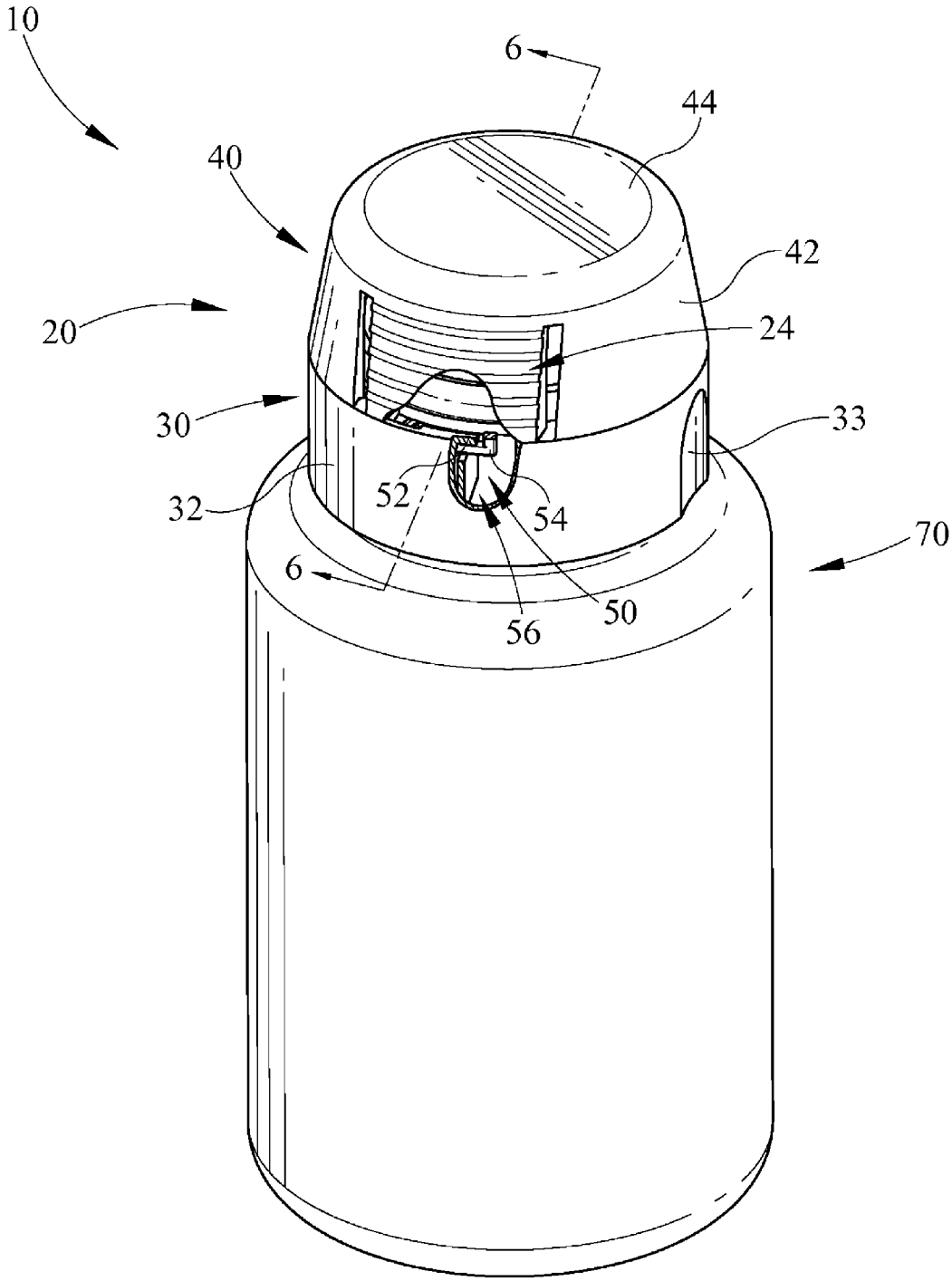
FIG. 1 is a perspective view of a flip-top dispensing system embodiment in a closed configuration engaging a container with the closure partially broken away.
Figure 2:
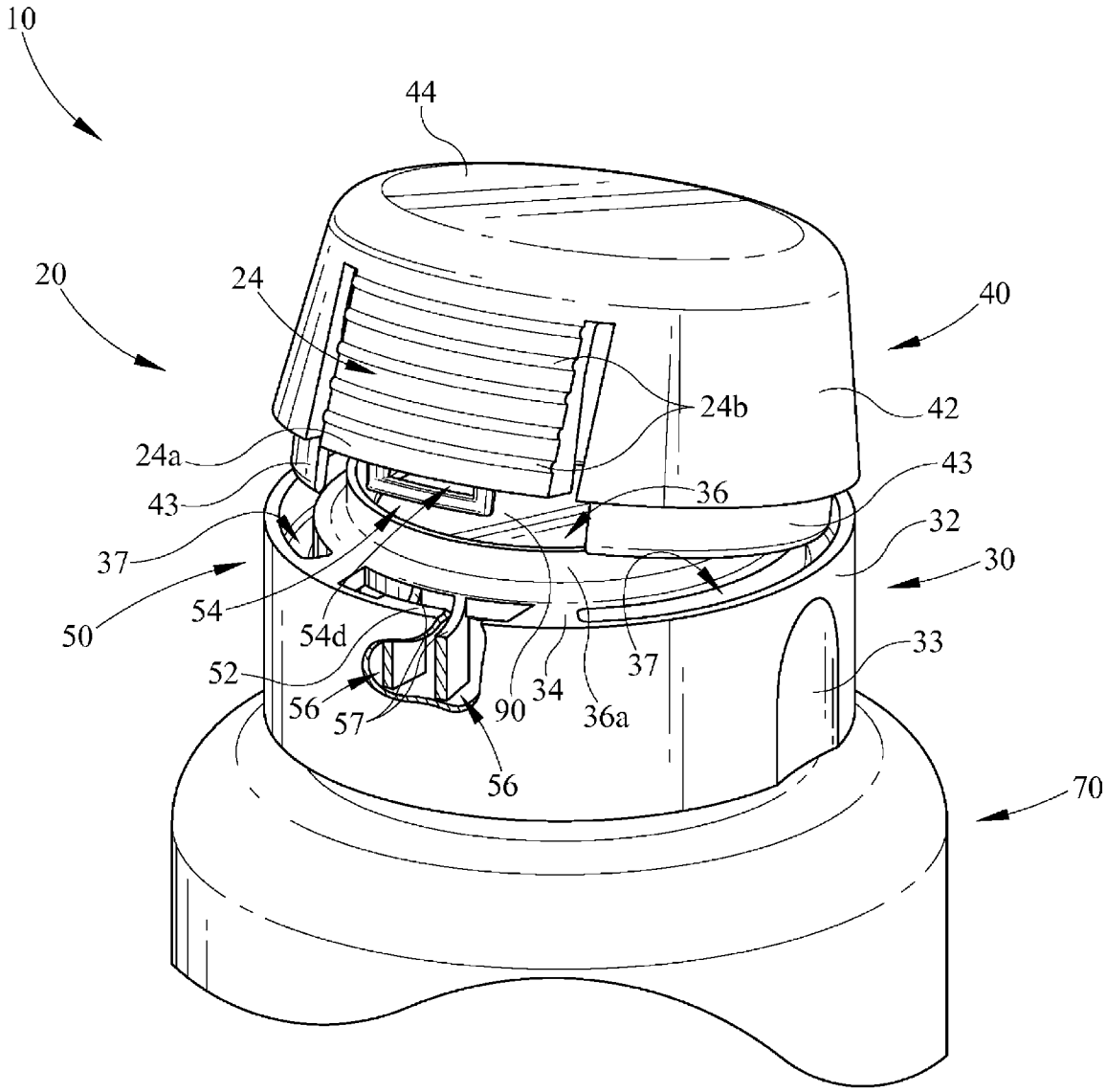
FIG. 2 is an enlarged perspective view of the flip-top dispensing system of FIG. 1 in a partially open configuration with the closure body and container partially broken away.

A flip-top dispensing system 10 according to one embodiment of the present invention depicted in the FIGS. 1-6 has a flip-top closure 20 structured to provide at least one adequate child resistant mechanism 50. The child resistant mechanism 50 discourages access to the contents of the container by children and others unable to recognize the danger. The flip-top closure 20 has a push button 24 requiring an opposed squeeze to overcome the safety feature and permit the opening of the flip-top closure lid 40.

Figure 6:
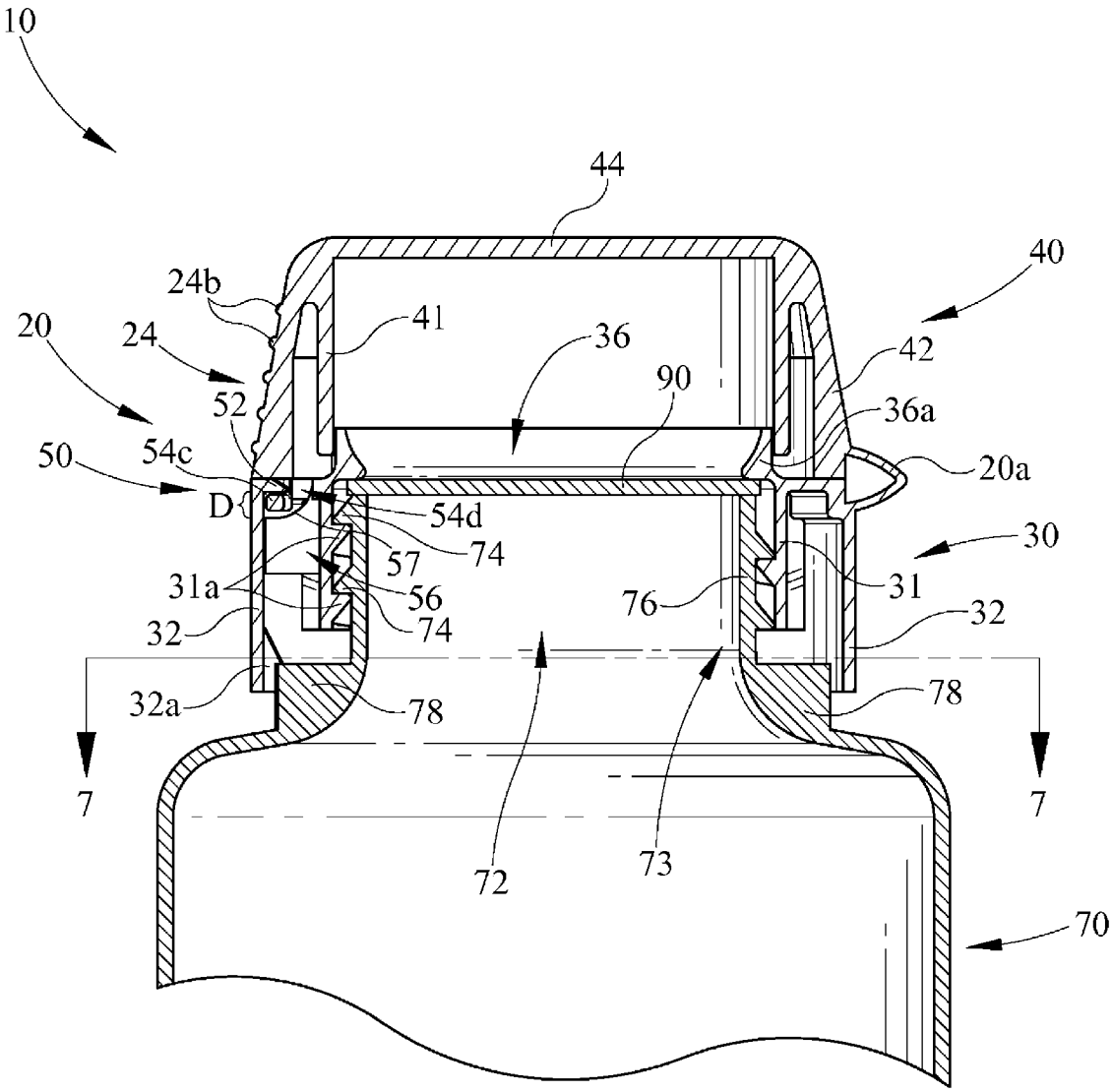
FIG. 6 is a sectional view of the flip-top dispensing system taken along line 6-6 of FIG. 1.

As shown in FIG. 1, container 70 may generally have an elongated cylindrical shape, but it is not limited to such and may be of a variety of shapes that best contains the product or has the greatest aesthetic appeal. As shown in FIG. 6, container 70 has a shoulder narrowing to a container neck finish 73 comprising a neck 76 that is of sufficient length to accommodate an external thread 74 for threaded engagement of flip-top closure 20 with the container. At the top of the neck 76 is an opening 72 permitting access to the contents of container 70. Container 70 may be made of unitary construction and made of any numerous materials commonly known in the art depending on specific product and environmental conditions. Some common examples of materials include but are not limited to polyethylene, polypropylene and polyethylene terephthalate. Container 70 is merely representative of containers in general, and it is to be understood that there are a variety of containers of different shape, size, and neck finish that may be used with the flip-top closure embodiments herein.

As illustrated in FIGS. 1-3, and 6, flip-top closure 20 engages container neck finish 73 of container 70 having an opening 72 therein. Flip-top closure 20 includes a closure base or body portion 30 and a lid 40. Lid 40 is hingedly connected to body 30. A hinge 20*a* accommodates movement of lid 40 from a closed position (FIG. 1) to an open position (FIG. 3) while maintaining the attachment of the lid to closure body 30. Hinge 20*a* may allow for the opening of lid 40 by a variety of means known in the art including but not limited to a living hinge type. Hinge 20*a* may also be bimodal wherein the hinge snaps lid 40 to either a fully open position (FIG. 3) or a fully closed position (FIG. 1). Alternatively, a hinge can be used to join a two piece molded flip-top closure. Closure body 30 may be characterized as having or defining an inner skirt 31 or outer skirt 32 for removably (FIGS. 1-3, 6, and 7) or non-removably (FIGS. 8 and 9) receiving neck finish 73 of container 70. As shown in FIG. 6, the inner skirt 31 interior includes suitable connecting means, such as the conventional thread 31*a* adapted to be threadingly engaged with mating external thread 74 of container 70. Although the engagement between closure body 30 and container 70 is shown in detail in FIG. 6, it is merely representative of engagements in general, and it is to be understood that there are a variety of attachment means that may be used with the child resistant latch mechanism embodiment herein.

Figure 3:
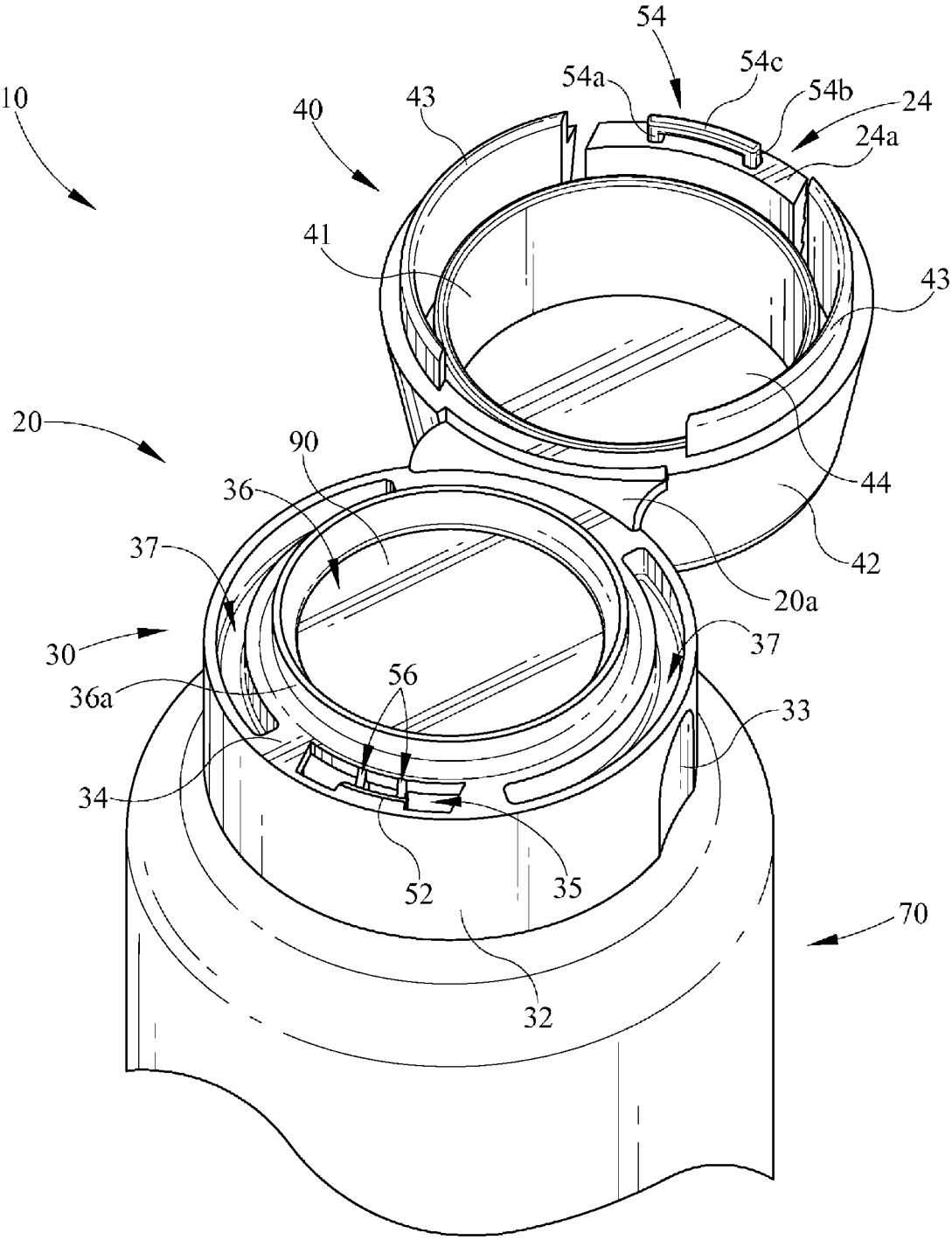
FIG. 3 is an enlarged perspective view of the flip-top dispensing system of FIG. 2 in an open configuration.
Figure 4:
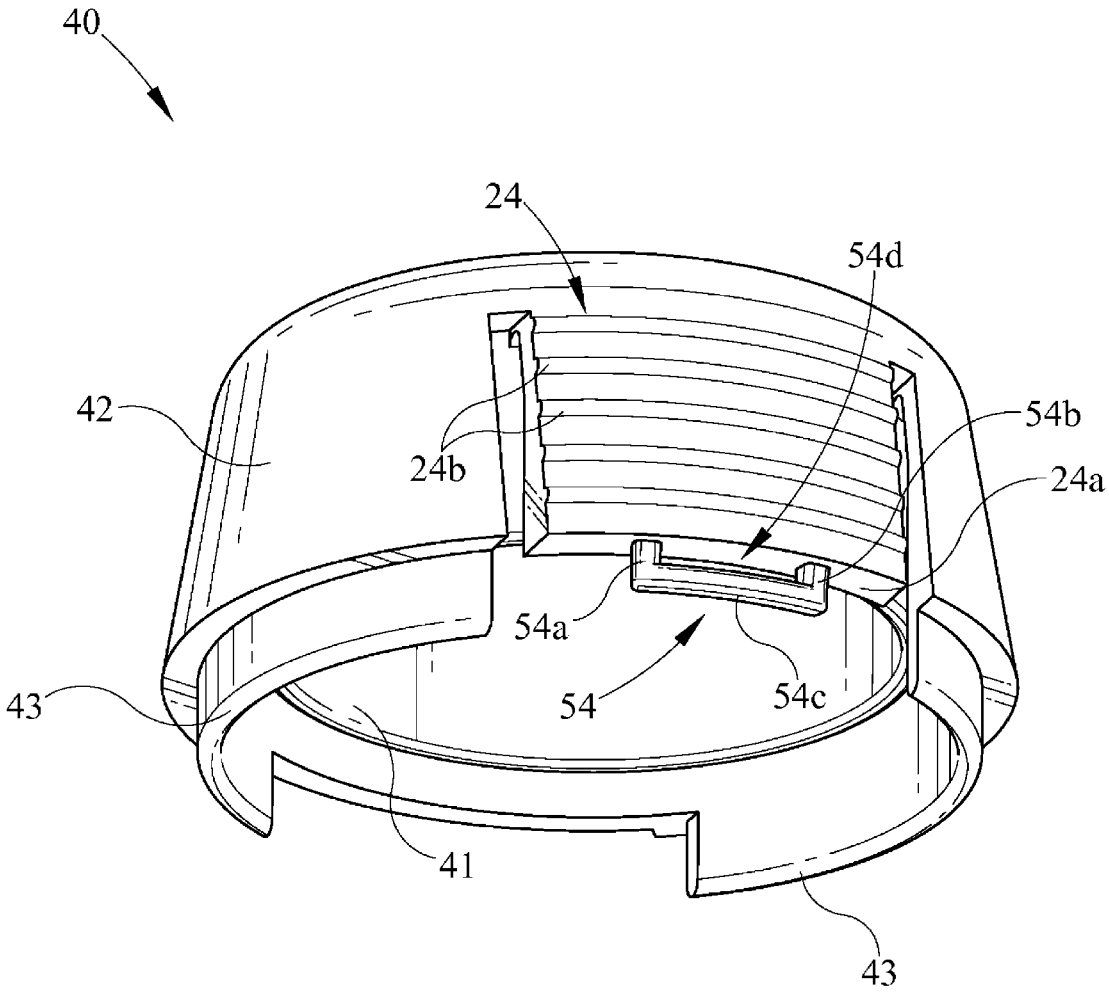
FIG. 4 is an enlarged, bottom perspective view of the flip-top closure of FIG. 1 with the closure body and hinge removed.
Figure 5:
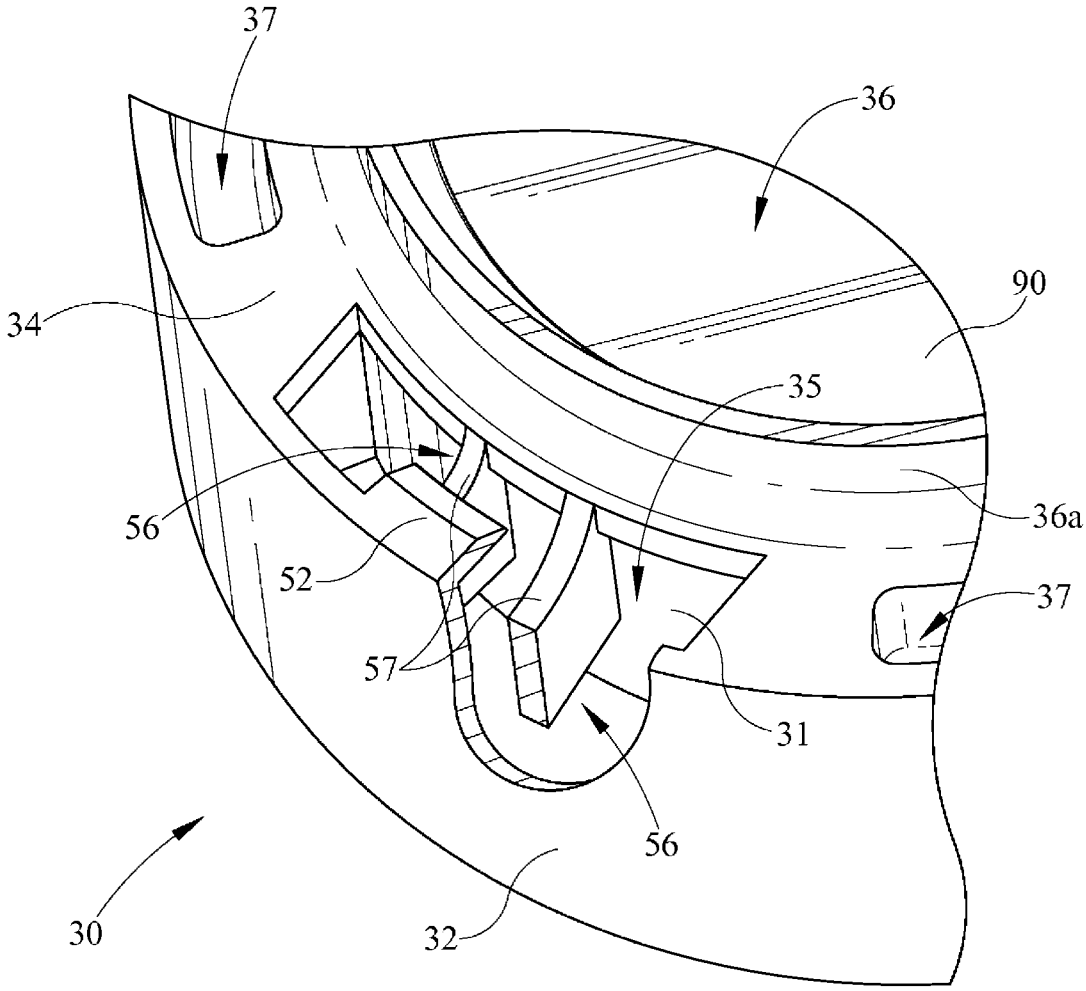
FIG. 5 is an enlarged, partial perspective view of the flip-top closure body of FIG. 2.

As shown in FIGS. 1-3, 5, and 6, the top of closure body 30 defines a peripheral deck 34. Within peripheral deck 34 is a closure body aperture 36, which may be defined by a spout 36*a*. When lid 40 is in the open configuration (FIG. 3), closure body aperture 36 permits contents to travel out of container opening 72. Closure body aperture 36 is shown in FIG. 3 to be circular in shape, however aperture 36 may take any number of sizes, quantities, positions, and shapes including ovalized, as will be recognized by one skilled in the art. To the outside of closure body aperture 36 within peripheral deck 34 is an opening 35 which forms a part of child resistant latch mechanism 50. Within opening 35 is a protrusion or latch retainer 52 projecting into the interior of the opening. Protrusion 52 operably engages a latch 54 of lid 40. Protrusion 52 may have a variety of shapes including a rib with a beveled surface as best shown in FIGS. 3 and 5, and may be provided in various quantities, sizes, and positions within opening 35 and still be within the scope of the embodiments of the invention.

Also included in latch mechanism 50, there may be a bias means facilitating the movement of a flexible latch 54 and/or push button 24 into and out of engagement with protrusion 52. As shown in FIGS. 2, 3, 5, and 6, one example of such bias means may be one or more latch guides 56 positioned between inner skirt 31 and outer skirt 32 (FIGS. 5 and 6) within opening 35 of closure body 30. Each latch guide 56 may be a continuous bridge between inner skirt 31 and outer skirt 32, or alternately may be a projection from either skirt. Each latch guide 56 have a running surface 57 which deflects latch 54 into its locked or tensioned position with protrusion 52 when lid 40 is closed. Running surface 57 may have an angled or curved, convex or concave (shown), shape. Each latch guide 56 further defines or restricts opening 35 defining a passageway for the ingress and egress of latch 54 with protrusion 52. When closing lid 40, the at least one latch guide 56 (two latch guides 56 are shown in the drawings) causes latch 54 and/or push button 24 or connections of each to flex or hinge and thereby facilitates its movement into and out of a locked position with protrusion 52. When closing closure 20, latch guide 56 generally flexes latch 54 in the direction of outer skirt 32. When opening closure 20, latch guide 56 generally flexes latch 54 in the direction of inner skirt 31. As shown in FIG. 6, latch guide 56 may be designed to define a distance D between running surface 57 and the protrusion 52 which creates an interference fit relationship between latch 54 and protrusion 52 when lid 40 is closed, to more tightly secure the latch. With such interference fit relationship, latch 54 may be more resistant to the opposed squeeze required to be applied to push button 24 when opening lid 40, which may be desirable in a variety of applications. The one or more latch guides 56 may be provided in a variety of different quantities, positions, shapes, and sizes and still function to appropriately direct latch 54 when moving between the open and closed positions of closure 20.

Although the latch mechanism 50 is shown in detail in the drawings, it should be understood that a variety of positions, quantities, sizes, shapes, and combinations thereof may be utilized and still be within the scope of the embodiments. Another embodiment may include the push button in another position and/or another shape within the closure lid or body, for example push button 24 may be attached at one or more surfaces by a thin membrane of material. Alternatively, another embodiment may contain multiple latch mechanisms, for example two latch mechanisms 50 diametrically opposed relative to the hinge of the flip-top closure. Another embodiment (not shown) may include inverting one or more of the positions of push button 24, latch 54, latch guide 56, and protrusion 52 relative to lid 40 and closure body 30.

Also shown in FIGS. 2, 3, 4, and 5, there are positioned around the periphery of peripheral deck 34 of closure body 30, one or more tooth guard openings or pockets 37 adapted to receive congruently shaped protrusions 43 depending from flip-top lid 40. The interaction of tooth guard openings 37 with depending lid protrusions 43 act as tooth guards to inhibit children from using their teeth or "biting" to pry open the flip-top lid 40. It is to be understood that the tooth guards can be provided in a variety of quantities, sizes, shapes and locations including inverting the positions of the openings 37 and the protrusions 43 relative to the lid 40 and closure body 30, while remaining within the scope of the embodiments.

As shown in the embodiments of FIGS. 1-4, and 6, lid 40 has a central deck or top wall 44 and a downwardly depending, outer peripheral skirt 42 and inner peripheral skirt 41. Located 180 degrees from hinge 20*a* is push button 24 making up a portion of outer peripheral skirt 42. Push button 24 forms a portion of peripheral skirt 42 to provide a guide for the proper location to apply squeeze pressure in order to overcome the safety features preventing the opening of flip-top lid 40. Push button 24 may have a plurality of radial ribs 24*b* or knurlings to facilitate grip and to distinguish itself from the outer periphery of the remaining wall portion of skirt 42. The user may initially lift lid 40 by applying an opposed squeeze to push button 24 to disengage the latch mechanism 50, combined with application of an upward force with a finger or thumb. Lid 40 may be rotated about hinge 20*a* to a fully opened position as shown in FIG. 3 to expose closure body aperture 36 opening the contents of container 70 to flow communication with the outside environment. As described above, lid 40 may also contain one or more protrusions 43 depending from top wall 44, or more specifically from outer peripheral skirt 42, to be received by corresponding tooth guard openings 37 and thereby combine to function as tooth guards. Inner peripheral skirt 41 of flip-top lid 40 may also be constructed as an orifice plug, a wrap around seal or a combination of both, or function as another type of sealing mechanism for sealingly engaging the closure body aperture 36.

An opposed squeeze is necessary to disengage the safety latch mechanism 50. As shown in FIGS. 2, 3, 4, and 6, push button 24 is positioned within outer peripheral skirt 42 of lid 40 and may or may not project therefrom. Push button 24 has a free distal end 24*a* from which projects latch 54. As shown in FIG. 3, latch 54 of the embodiment illustrated is substantially U-shaped or stirrup shaped wherein two opposed members 54*a* and 54*b* depend from free distal end 24*a* and are connected by a horizontal member 54*c*, defining an opening or pocket 54*d*. In operation while closing lid 40 upon closure body 30, push button 24 and/or latch 54 flexes allowing horizontal member 54*c* to travel under the distal free end of protrusion 52 and subsequently flexing back to its flush position with outer skirt 42. This allows opening 54*d* to engage the free end of protrusion 52, locking the latch in its engaged position with horizontal member 54*c* or other such latch contact surface in contact with the underside surface of protrusion 52. Members 54*a* and 54*b* may also contact the corresponding vertical end surfaces of protrusion 52 when latch 54 is in the locked position. As described above, latch 54 and/or protrusion 52 may be beveled in shape to facilitate the operable engagement. As can be seen with regard to the embodiment of FIGS. 5 and 6, latch guides 56 direct latch 54 along their running surfaces 57 into a forward or locked position with protrusion 52. Push button 24 and latch 54 preferably have a substantial amount of natural memory to flex back and engage protrusion 52 when closing lid 40 upon closure body 30. However, latch guides 56 consistently direct or guide latch 54 forward into its locked position with protrusion 52. As latch mechanism 50 is engaged in use, it provides a child resistant safety mechanism preventing the opening of lid 40. In order to overcome the safety latch mechanism 50, an opposed squeeze is applied to push button 24. The opposed squeeze flexes push button 24 radially inward from the locked position in which latch 54 may flex as it is guided back along running surface 57 of latch guide 56 until it disengages from protrusion 52. Latch 54 may be provided in a variety of shapes, sizes, quantities, and positions and still have a latch catch surface operably engage one or more protrusions 52 of closure body 30. For example, latch 54 may have one or more, but is not limited to, round, square, or half-moon shaped openings 54*d* which may be fully enclosed within the latch outer periphery or removed from the outer edge of the latch. The outer periphery shape of latch 54 may be round, square, triangular, or any other polygonal shapes.

Latch mechanism 50 may be created using a straight open and closed molding action. Latch mechanism 50 is designed to flex or jump upon ejection from the mold preventing the latch 54 from being deformed or destroyed. Latch 54 is jumped out of the mold by appropriately sequencing the extraction of mold cores forming lid 40. The inner cores forming lid 40 are initially removed from the newly molded lid so the outer mold core can be retracted. When outer mold core is retracted latch 54 and/or push button 24 is able to flex radially inward, thus allowing the outer mold core to release from latch 54, or more specifically opening 54*d*. The horizontal member 54*c* of latch 54 may be cam shaped to facilitate the release of the outer mold core. By using a straight open and closed molding method, the cycle speed of production and the number of closures per mold may be increased, and the complexity of the mold cavities may be reduced as compared to a lateral molding method that would otherwise be needed. Also, as a result of this method of molding latch 54, push button 24 may be positioned substantially flush with the peripheral surface of the lid skirt 42 or alternatively may protrude outside the lid's outer surface. Thus the outer surface diameter of lid 40 may be equal to the outer surface diameter of closure body 30 at the point where closure body 30 intersects with lid 40. This provides an aesthetically pleasing closure 20 with a continuous or flush transition between closure body 30 and lid 40. A flush or protruding push button 24 will also aid in seniors and those with large finger nails to readily access the push button to apply the opposed squeeze necessary to open the lid.

Figure 10:
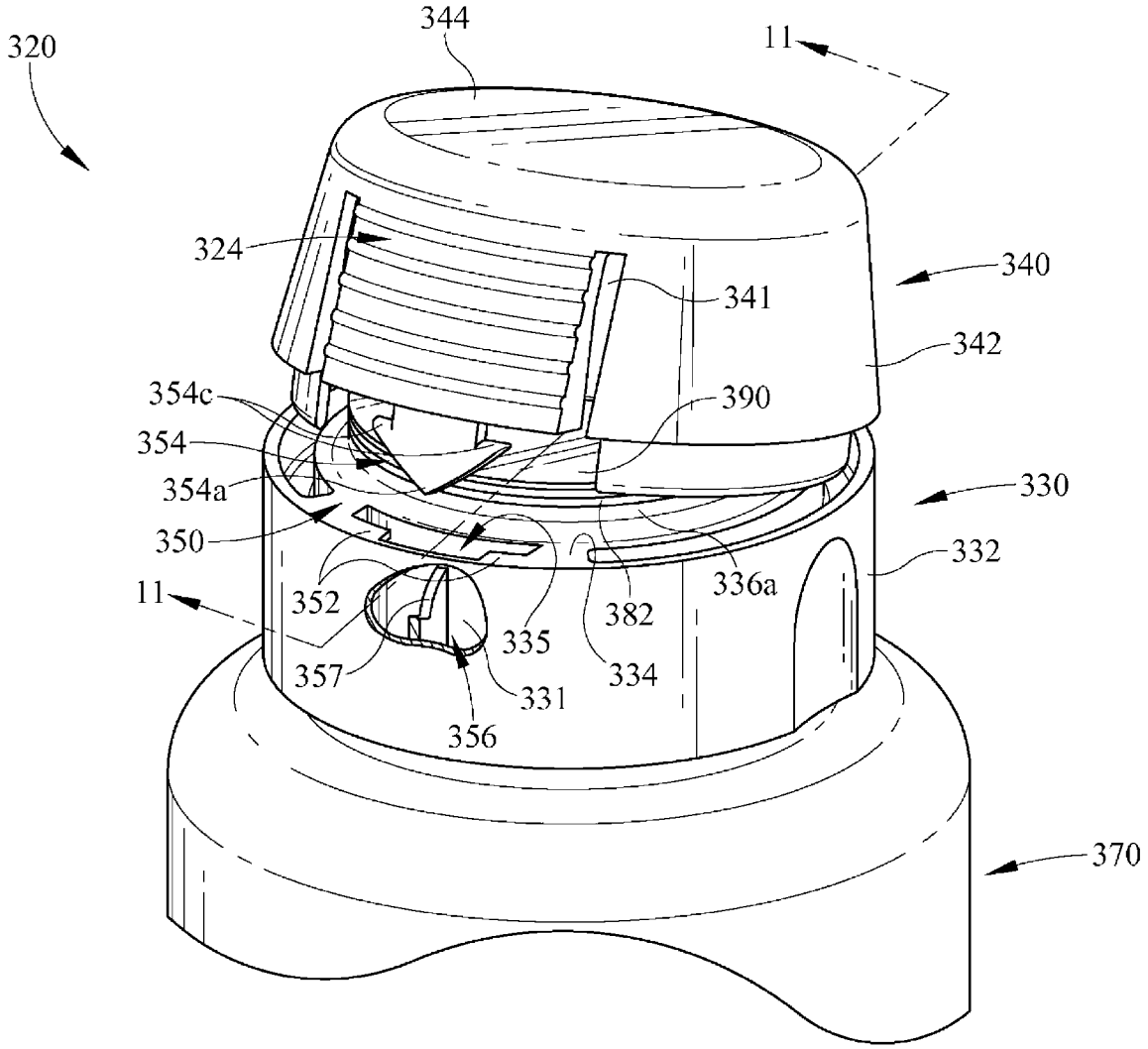
FIG. 10 is a perspective view of another flip-top dispensing system with the flip-top closure body partially broken away.
Figure 11:
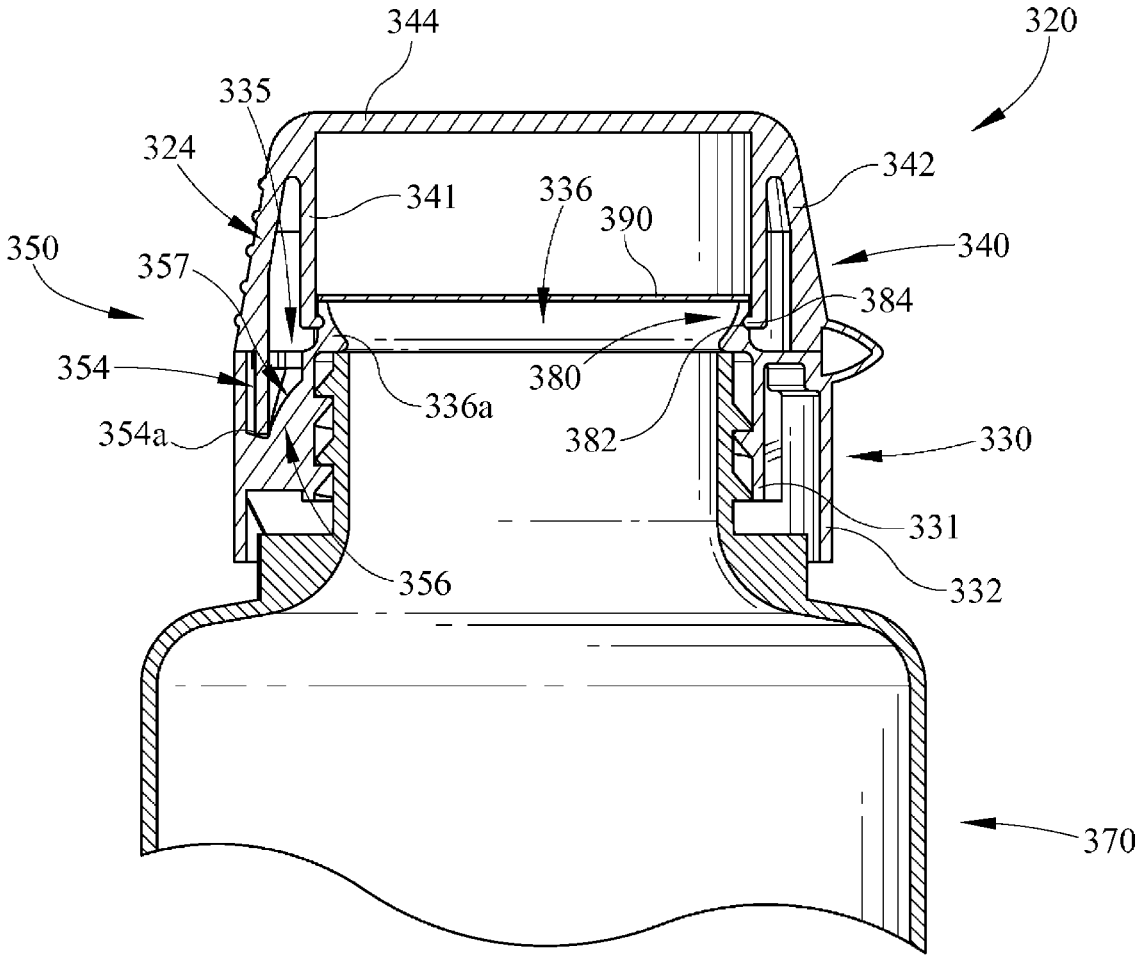
FIG. 11 is a sectional view of the flip-top dispensing system in a closed configuration taken along line 11-11 of FIG. 10.

As shown in FIGS. 2, 3, 5, and 6, when solid container products, such as vitamins, are stored in container 70, an inner seal or foil seal 90 may be used as a tamper indicating means. Alternatively a seal 390 may be positioned on the lip of a spout 336*a* disposed above flip-top closure body aperture 336 as shown in FIGS. 10 and 11. Also peripheral deck 34 of closure body 30 may have a rotary seal (not shown) depending therefrom such as a plug seal when for instance liquids are stored in the container. A variety of tamper indicating means known to those skilled in the art may also be used with the embodiments of this invention; for example a linerless folding bead may be used to seal the container by pressing against a lip of container neck 76. These seals preferably provide a sealing engagement when the closure is disposed in a locked position with the container. As shown in FIGS. 10 and 11, a bead and groove engagement 380 may also be present between inner peripheral skirt 341 and spout 336*a*. A bead 384 is shown as a projection from an interior surface of inner peripheral skirt 341, while a groove 382 is positioned in an exterior surface of spout 336*a*. The bead and groove engagement 380 may be provided in a variety of different positions, shapes, sizes, and quantities and still be within the scope of the invention. The bead and groove engagement 380 may be a USP 671 tight rating for moisture vapor transmission.

Figure 8:
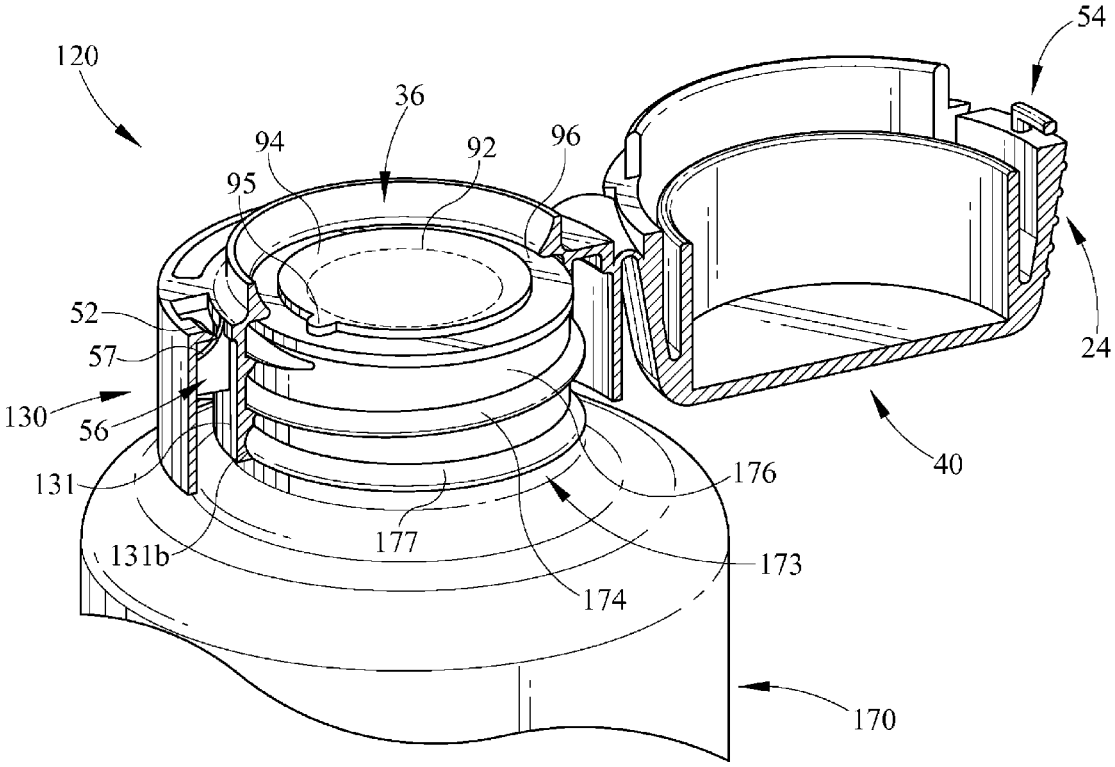
FIG. 8 is a perspective view of another flip-top dispensing system in an open configuration illustrating an embodiment of a non-removable closure with the flip-top closure partially broken away.
Figure 9:
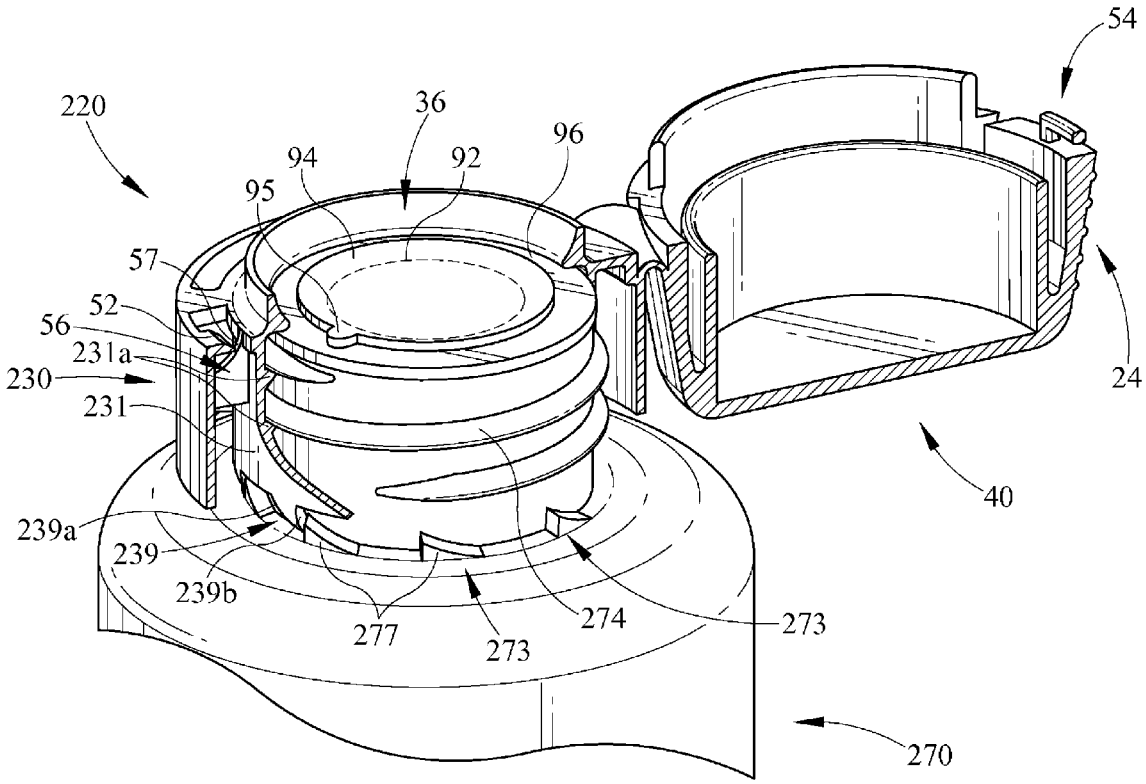
FIG. 9 is a perspective view of another flip-top dispensing system in an open configuration illustrating an embodiment of a non-removable closure with the flip-top closure partially broken away.

Another embodiment of a tamper indicating means is shown in FIGS. 8 and 9. A dispenser 96 with aperture 92 and a peelable seal 94 may be utilized and located within the dimensions of the flip-top closure body aperture 36, allowing the user to open flip-top lid 40 and remove the peelable seal without having to remove the closure from the container. The user will have the convenience of opening flip-top lid 40 and removing the peelable aperture seal 94 to get immediate access to the product (pills, etc.) of the container. One or more portions of peelable seal 94 may be left unattached to grasp and use as a tab 95 for pulling seal 94 free of dispenser 96. Of course, peelable seal 94 and pull tab 95 may be provided in a variety of other shapes, sizes, and positions on the dispenser and still be utilized to provide a free portion for grasping by the consumer. Also, flip-top lid 40 may be transparent allowing a consumer to visually inspect the integrity of a variety of container seals.

Figure 7:
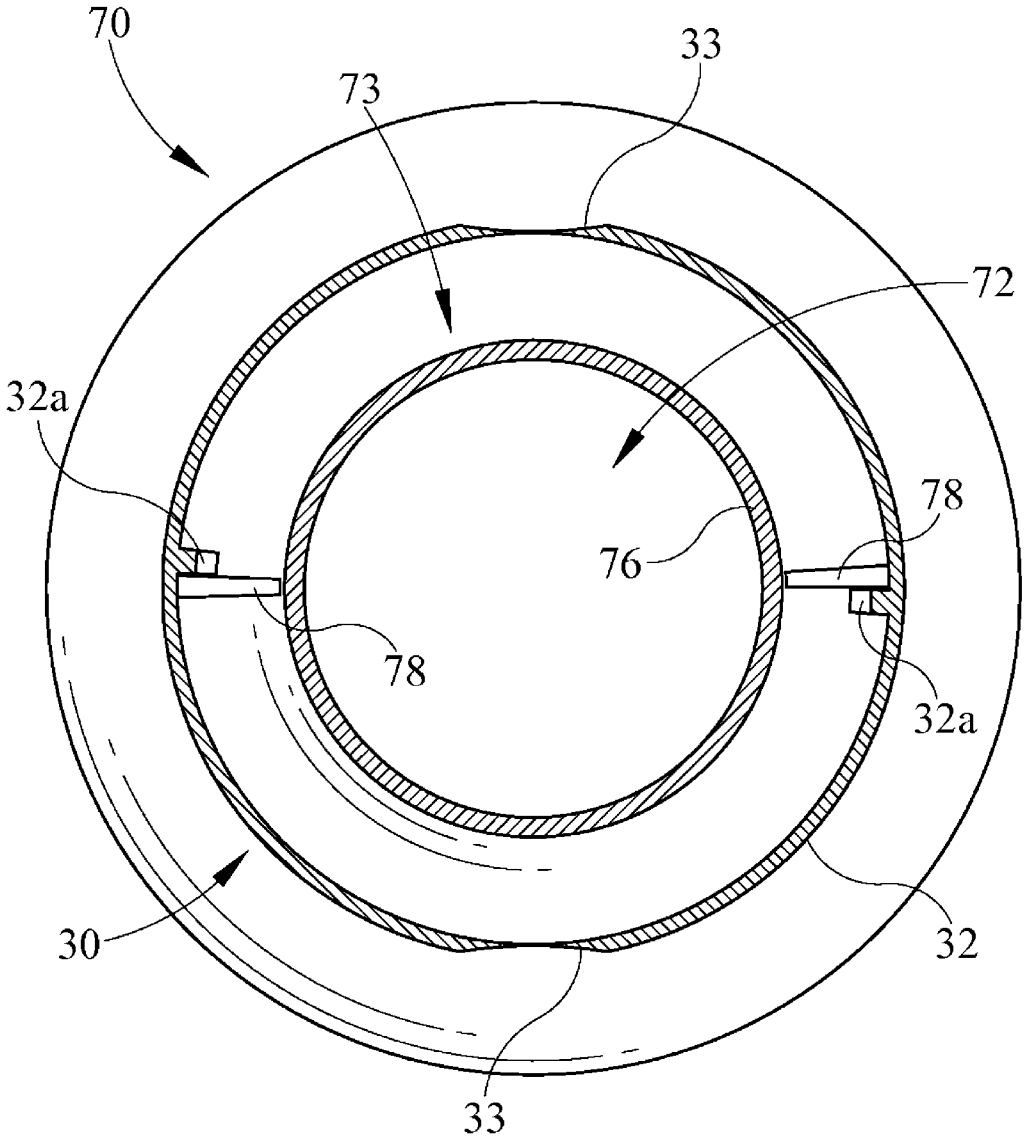
FIG. 7 is a sectional view of the flip-top dispensing system taken along line 7-7 of FIG. 6.

As shown in FIGS. 1-3, 6, and 7, latch mechanism 50 may be included in a removable flip-top closure 20 having additional child resistant features. Depending from a peripheral edge of closure body 30 is outer peripheral skirt 32, forming a first shell of the double shell flip-top closure 20. Outer skirt 32 is preferably formed of plastic, such as polypropylene having a thickness allowing the outer skirt to flex into an ovalized shape when "pinched" at pressure points 33 spaced apart by about 180 degrees. Outer skirt 32 may be straight or tapered. Pressure points 33 are recessed finger guides which may be molded into the lower portion of outer skirt 32 as the closure is formed. Pressure points 33 are distinguishable on the lower portion of outer skirt 32 finish to provide a user with visual reference of the locations where the closure body 30 should be squeezed. Pressure points 33 are also spaced about 90 degrees apart from a pair of child resistant lugs 32*a* (FIG. 7). The child resistant lugs 32*a* are accordingly also diametrically opposed to each other, disposed along an inner surface of the lower portion of outer skirt 32, and may provide cam surfaces which engage container lugs 78 (FIGS. 7 and 8) disposed along container neck finish 73. The child resistant lugs 32*a* will cam over container lugs 78 disposed on neck finish 73 when the closure 20 is secured onto container 70. More specifically, outer skirt 32 will flex as child resistant lugs 32*a* move into abutment with container lugs 78, locking the closure in place. Child resistant lugs 32*a* may have at least one tapered side, which facilitates passage of child resistant lug 32*a* past container lug 78 as the double shell closure 20 is rotated onto container 70. When pressure points 33 are depressed by a user, the force causes outer skirt 32 to flex into an oval shape, thus moving each child resistant lug 32*a* out of engagement with container lugs 78. This disengagement thus allows double shell closure 20 to be threadably removed from the container 70.

As shown in FIGS. 3 and 6, depending from a lower surface of peripheral deck 34 is inner peripheral skirt 31 which may be molded with outer skirt 32 to form the double shell closure body 30. Helically extending about the inner surface of inner skirt 31 is thread 31*a*. Thread 31*a* operably engages thread 74 helically disposed about an external portion of container neck finish 73. Inner skirt 31 may have a thickness which will not substantially deform when pressure points 33 on outer skirt 32 are depressed causing ovalized deformation of the outer skirt.

As will be recognized by those skilled in the art, the main parts of flip-top closure 20, either closure body and/or lid, may be provided in any number of different shapes and sizes and still function to provide a child resistant latch mechanism 50. As described above, child resistant latch mechanism 50 may be used with a number of different removable and non-removable closures that may or may not include a child resistant connection with the container.

An alternative child resistant closure 120 is depicted in FIG. 8, which comprises a non-removable closure disposed on a container neck finish 173 of container 170. Child resistant flip-top closure 120 is threadably fastened to container neck finish 173 which comprises a least one thread 174 helically extending around the outer surface of the neck 176. At least one neck bead 177 may be disposed beneath thread 176 in position to engage a lower closure lug or groove 131*b* extending from the inner skirt 131 of closure 120. Since the closure lug 131*b* passes over container neck bead 177 during application of closure 120 to container neck finish 173, the closure is locked in place on the container neck 176 and may not be removed therefrom without damaging the closure. Other embodiments may not comprise threads which engage the closure to the container but which rely only on a non-removable engagement mechanism, such as the neck bead 177 and lug 131*b*.

As shown in FIG. 9, another alternative embodiment of the flip-top dispensing system is depicted comprising yet an additional embodiment of a non-removable child resistant closure 220. An inner skirt 231 of closure body 230 comprises at least one closure thread 231*a* extending along an inner surface of the inner skirt and operably engaging a container thread 274 on container neck finish 273. Depending from a lower edge of the inner skirt 231 are a plurality of ratchet teeth 239 which engage opposed teeth 277 of the container neck finish 273. Alternatively, ratchet teeth may extend radially inwardly from the inner skirt and engage with a plurality of container neck ratchet teeth extending radially outwardly from a container neck finish, as the closure is applied to the container. Ratchet teeth 239 are substantially triangular in shape and comprise a first tapered surface 239*a* and a second engagement surface 239*b*. The first tapered surface 239*a* is disposed at and angle of 45 degrees or less from the bottom edge of the inner skirt 231 allowing the ratchet teeth 239 to pass over the opposed container ratchet teeth 277 when closure 220 is rotated clockwise (as in the embodiment of FIG. 9) onto container neck finish 273. Further, second engagement surface 239*b* of ratchet teeth 239 is disposed at an angle greater than 45 degrees from the bottom edge of the inner skirt 231. Accordingly, when rotated in the reverse direction (counterclockwise in the embodiment of FIG. 9), the second engagement surface 239*b* engages the opposed container neck ratchet 277 inhibiting removal. In addition, a neck bead may also be utilized as described above to further inhibit removal of closure 220 from the container neck.

Another embodiment of the flip-top dispensing system, a closure 320 engaging a container 370, is depicted comprising yet an additional embodiment of a latch mechanism 350 is shown in FIGS. 10 and 11. A lid 340 has a top wall 344 and a depending outer peripheral skirt 342 and inner peripheral skirt 341. The top of closure body 330 defines a peripheral deck 334. Within peripheral deck 334 is an opening 335 which forms part of child resistant latch mechanism 350. Within opening 335 is at least one latch retainer 352, shown in FIG. 10 as two latch retainers, projecting into the interior of the opening 335. Latch retainers 352 operably engage latch 354 depending from push button 324 of lid 340. Also within opening 335, is a latch guide 356 shown as a single vertical rib or bridge positioned between the inner skirt 331 and outer skirt 332. Latch guide 356 has a running surface 357 which deflects latch 354 forward into its locked position with latch retainers 352. Running surface 357 is at least in part substantially convex in shape.

As shown in FIGS. 10 and 11, latch 354 of latch mechanism 350 is substantially shovel or arrow shaped. Latch 354 is guided or flexed into and out of its locked position with latch retainers 352 by latch guide 356. Latch 354 has two opposing substantially horizontal surfaces 354*c* or latch catch surfaces, opposite the distal free end or point 354*a* of the arrow shaped latch, which engage the underside surface of latch retainers 352 when lid 340 is closed and the latch 354 is in its locked or tensioned position. As described above, horizontal surfaces 354*c* may also be cam shaped in order to assist in jumping or flexing the latch from the mold cavity during the molding process.

It is understood that while certain embodiments of the invention have been illustrated and described, it is not limited thereto except insofar as such limitations are included in the following claims and allowable functional equivalents thereof.

We claim:

1. A child resistant dispensing closure comprising:

a lid hingedly connected to a body having an outer skirt, said body also having a dispensing orifice on an upper deck;

a latch projecting towards said body outer skirt from a depending push button on said lid of said closure, wherein said latch has a latch catch surface;

said depending push button on said lid formed in a lid side wall and connected to said lid by a deflectable hinge along an upper edge, said deflectable hinge allowing said push button to be deflected inwards relative to said lid side wall;

a latch retainer on said body of said closure; and a biasing cam on said body of said closure below a latch receiving opening which receives said latch when said lid is in a closed position relative to said body, said biasing cam positioning said latch catch surface from a first radial position to a second radial position, said second radial position is at a larger radial distance than said first radial position, said latch catch surface is in operable engagement with said latch retainer on said body when in said second radial position.

2. The child resistant dispensing closure as in claim 1 wherein said latch is substantially stirrup in shape.

3. The child resistant dispensing closure as in claim 1 wherein said latch is substantially arrow in shape.

4. The child resistant dispensing closure as in claim 1 wherein said biasing cam on said body of said closure includes at least one vertical rib.

5. The child resistant dispensing closure as in claim 1 wherein said biasing cam on said body of said closure includes a running surface for guiding said latch into and out of engagement with said latch retainer.

6. The child resistant dispensing closure as in claim 5 wherein said running surface is substantially curved in shape.

7. The child resistant dispensing closure as in claim 6 wherein a portion of said running surface is convex in shape.

8. The child resistant dispensing closure as in claim 1 wherein said upper deck of said body has a spout surrounding said dispensing orifice.

9. The child resistant dispensing closure as in claim 1 wherein said upper deck of said body has one or more tooth guard openings receiving one or more tooth guard protrusions depending from said lid side wall when said lid is in said closed position relative to said body.

10. The child resistant dispensing closure as in claim 1 wherein said push button is flush with said lid side wall of said lid.

11. The child resistant dispensing closure as in claim 1 wherein said biasing cam on said body of said closure flexes one or both of said latch and said push button when positioning said latch into and out of engagement with said latch retainer.

12. A dispensing closure comprising:

a lid hingedly connected to a cap body and positionable between a closed position and an open position relative to said cap body, said cap body having a dispensing orifice on an upper deck;

a latch projecting from a push button on said lid of said closure, wherein said latch has a latch catch surface, said push button is deflectable relative to said lid by a hinge; and a latch guide on said cap body of said closure consistently biasing said latch catch surface between a first radial position and a second radial position, said latch catch surface contacts with a latch retainer in said second radial position on said cap body when said lid is in said closed position, whereby said latch guide radially holds the contact between said latch catch surface and said latch retainer in said second radial position until disengaged by a user.

13. The dispensing closure as in claim 12 wherein said latch guide has a running surface leading said latch into and out of engagement with said latch retainer.

14. The dispensing closure as in claim 13 wherein said running surface is substantially curved in shape.

15. The dispensing closure as in claim 14 wherein a portion of said running surface is convex in shape.

16. The dispensing closure as in claim 12 wherein said latch guide is at least one vertical rib.

17. The dispensing closure as in claim 12 wherein said latch is substantially stirrup in shape.

18. The dispensing closure as in claim 12 wherein said latch is substantially arrow in shape.

19. The dispensing closure as in claim 12 wherein said push button is flush with an exterior surface of said cap body.

20. A flip-top closure with a latch guide comprising:

a closure body having a lid hingedly connected thereto, said lid having a top wall with a depending skirt, a portion of said skirt having a depending push button;

a latch depending from said push button, said latch having a latch catch surface; and said closure body having a top plane, said top plane having a dispensing orifice and a latch receiving opening, and said latch receiving opening having a latch retainer positioned radially outward relative to a latch guide, said latch guide positioning said latch catch surface of said push button latch radially outward in operable engagement with said latch retainer when said lid is in a closed position relative to said closure body, said latch guide also positioning said latch radially inward out of operable engagement with said latch retainer when disengaged by the user.

21. The flip-top closure as in claim 20 wherein said push button is flush with an exterior surface of said lid.

22. The flip-top closure as in claim 20 wherein said latch guide has a running surface for guiding said latch into and out of engagement with said latch retainer.

23. The flip-top closure as in claim 22 wherein said running surface is substantially curved in shape.

24. The flip-top closure as in claim 23 wherein a portion of said running surface is convex in shape.

25. The flip-top closure as in claim 20 wherein said latch is substantially stirrup in shape.

26. The flip-top closure as in claim 20 wherein said latch is substantially arrow in shape.

27. A hinged lid flip-top closure with a bias cam, comprising:

a base with a deck and a dispensing orifice on said deck;

a flip-top hingedly connected to said base and having a top wall and an annular depending side wall with a deflection panel, said deflection panel having a depending latch with an upper latch surface; and said deck of said base having a latch aperture and a bias cam below said aperture, said bias cam is positioned at a first radial distance of said base, said bias cam in outward deflecting alignment with said latch when said flip-top is closed causing said upper latch surface to radially contact a catch at a second radial distance on an inner wall of said base, said second radial distance is larger than said first radial distance.

28. The hinged lid flip-top closure as in claim 27 wherein said deck has a depending annular skirt which encloses said latch when said flip-top is closed.

* * * * *

UNITED STATES PATENT AND TRADEMARK OFFICE

CERTIFICATE OF CORRECTION

PATENT NO. : 7,861,873 B1
APPLICATION NO. : 11/754471
DATED : January 4, 2011
INVENTOR(S) : Jason Bragg et al.

It is certified that error appears in the above-identified patent and that said Letters Patent is hereby corrected as shown below:

Column 6, Line 1: replace “FIGS. 7 and 8” with --FIGS. 6 and 7--
Column 6, Line 38: replace “a” with --at--

Signed and Sealed this
Tenth Day of April, 2012

David J. Kappos

David J. Kappos
*Director of the United States Patent and Trademark Office*